US010781580B1

(12) United States Patent
Donohue

(10) Patent No.: US 10,781,580 B1
(45) Date of Patent: Sep. 22, 2020

(54) TOILET BOWL STRIKE PAD

(71) Applicant: Joseph Guy Donohue, Tulsa, OK (US)

(72) Inventor: Joseph Guy Donohue, Tulsa, OK (US)

( * ) Notice: Subject to any disclaimer, the term of this patent is extended or adjusted under 35 U.S.C. 154(b) by 10 days.

(21) Appl. No.: 16/270,272

(22) Filed: Feb. 7, 2019

(51) Int. Cl.
*E03D 9/00* (2006.01)
*A47K 17/00* (2006.01)

(52) U.S. Cl.
CPC ..... *E03D 9/005* (2013.01); *A47K 17/00* (2013.01)

(58) Field of Classification Search
CPC ..... A47K 17/00; E03D 9/005
See application file for complete search history.

(56) References Cited

U.S. PATENT DOCUMENTS 2,703,407 A * 3/1955 Henoch ..... A61F 5/00 434/247
2,931,047 A 4/1960 Stebbins
3,614,790 A 10/1971 Billingsly et al.
4,215,443 A 8/1980 Babik
5,930,847 A 8/1999 Hall
6,385,784 B1 * 5/2002 Donohue ..... E03D 9/00 4/300.3
6,513,172 B1 * 2/2003 Norton ..... A47K 13/24 4/300.3

* cited by examiner

*Primary Examiner* — Jeremy Carroll
(74) *Attorney, Agent, or Firm* — Frank J. Catalano; Gable Gotwals

(57) ABSTRACT

A strike pad for a toilet bowl has a rigid frame securing a porous and splash-inhibiting target pad and a porous release pad to form a pocket encapsulating a water-soluble product. When the seat is down, the water-soluble product and porous release pad are below the standing water level and the porous and splash-inhibiting target pad is above the standing water level. The target pad fragments and captures the urine stream. On flushing, the swirling high water flows through and rinses both pads, releasing some of the water-soluble product which may be scented, disinfecting or otherwise beneficial.

7 Claims, 3 Drawing Sheets

TOILET BOWL STRIKE PAD

BACKGROUND OF THE INVENTION

This invention relates generally to bathroom accessories and more particularly concerns a strike pad for a typical household toilet.

A toilet bowl strike pad or screen and associated bowl mount and seat-driven linkage are disclosed in U.S. Pat. No. 6,385,784. The linkage automatically rotates a strike pad into or out of a target orientation in response to the rotation of the toilet seat toward a raised approximately vertical condition or a lowered approximately horizontal condition, respectively. When the seat is fully raised, the strike pad is a target. When the seat is fully lowered, the strike pad is stored at the back of the bowl out of the water.

Since the known strike pads reduce splatter by redirecting a stream of urine before it strikes the water surface in the bowl, when the seat is fully raised they must be above the standing water level. When the seat is fully lowered, they are washed clean by the higher level of water that swirls in contact with the redirecting surface during flushing. Surface contact washing efficiency increases with smoother pad surfaces. But smoother pad surfaces increase splatter. The countervailing impacts of pad surface smoothness limit the benefits to be derived with known strike pads. Furthermore, the above-standing-water requirement precludes other benefits that might be gained from use of a strike pad.

It is, therefore, an object of this invention to provide a toilet bowl strike pad that affords greater splatter reduction than known pads. Another object of this invention is to provide a toilet bowl strike pad that does not require a smooth contact surface. It is also an object of this invention to provide a toilet bowl strike pad that need not be entirely above the standing water level of the bowl in a fully-lowered condition. A further object of this invention to provide a toilet bowl strike pad capable of dispersing scented product into the bowl. And it is an object of this invention to provide a toilet bowl strike pad capable of dispersing disinfectant into the bowl.

SUMMARY OF THE INVENTION

In accordance with the invention, a toilet bowl strike pad is provided for use in combination with a linkage mounted on the toilet bowl and operated in response to the rotation of the toilet seat toward a raised approximately vertical condition or a lowered approximately horizontal condition.

The toilet bowl strike pad has a rigid frame with an inside wall that defines an endless perimeter. A porous target pad and a porous release pad have perimeters sized to overlap the endless inside wall perimeter of the frame. The target and release pad perimeters are secured in the frame and form a pocket between the pads.

A water-soluble product is encapsulated in the pocket. An arm extending from the frame is adapted to be connected to the linkage to orient the frame approximately horizontally in the bowl with the porous target pad above the threshold standing water level of the bowl when the seat is in the raised approximately vertical condition.

Preferably, the arm is further adapted to be connected to the linkage to orient the frame approximately horizontally in the bowl with the porous release pad and the water-soluble product at least partly below the threshold standing water level of the toilet bowl while the porous target pad is above the threshold standing water level of the bowl.

Preferably, the porous target pad is splash-inhibiting and the water-soluble product releases a scent or disinfectant. The frame is preferably ovate and may be formed in a laminar arrangement of frame portions securing the perimeters of the target and release pads.

BRIEF DESCRIPTION OF THE DRAWINGS

Other objects and advantages of the invention will become apparent upon reading the following detailed description and upon reference to the drawings in which.

Figure 1:
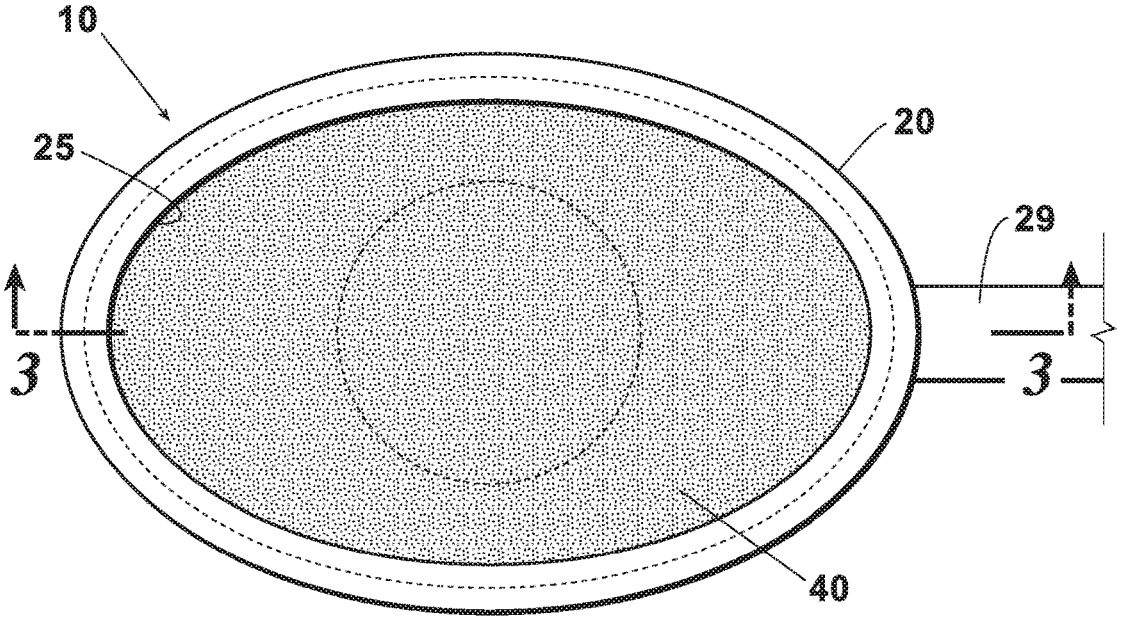
FIG. 1 is a top plan view of a preferred embodiment of the strike pad.
Figure 2:
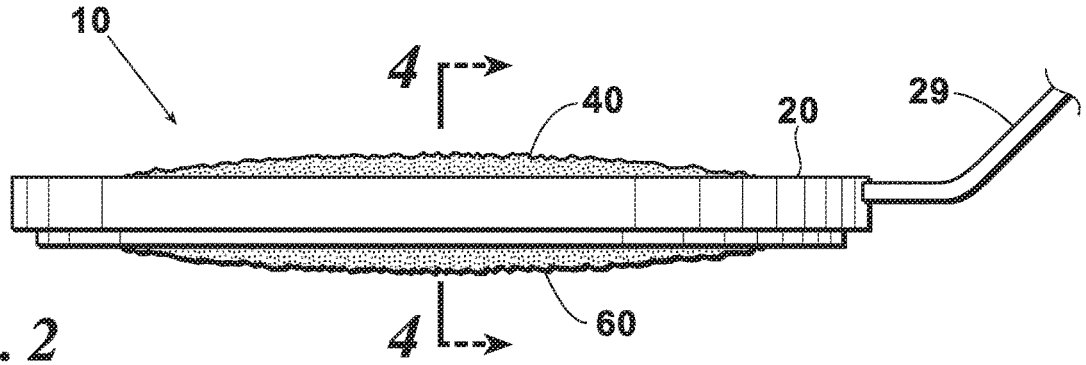
FIG. 2 is a front elevation view of the strike pad of FIG. 1.

While the invention will be described in connection with a preferred embodiment, it will be understood that it is not intended to limit the invention to that embodiment. On the contrary, it is intended to cover all alternatives, modifications and equivalents as may be included within the spirit and scope of the invention as defined by the appended claims.

DETAILED DESCRIPTION

A strike pad 10 illustrated in the drawings serves as a target for a stream of urine into a toilet bowl (not shown). The strike pad 10 is adapted to be combined with a linkage (not shown) that operates in response to the rotation of the toilet seat (not shown) toward its raised approximately vertical condition leaning back against the tank of the toilet or toward its lowered approximately horizontal condition atop the rim of the bowl.

As seen in FIGS. 1-4 and 8, the strike pad 10 has a rigid frame 20, a target pad 40 and a release pad 60 secured in the frame 20, and a water-soluble product 80 encapsulated between the pads 40 and 60.

Figure 3:
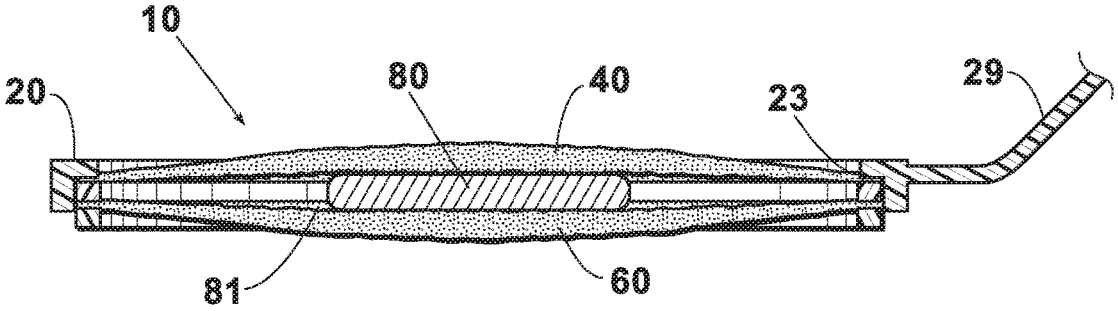
FIG. 3 is a cross-sectional view taken along the line 3-3 of FIG. 1.
Figure 8:
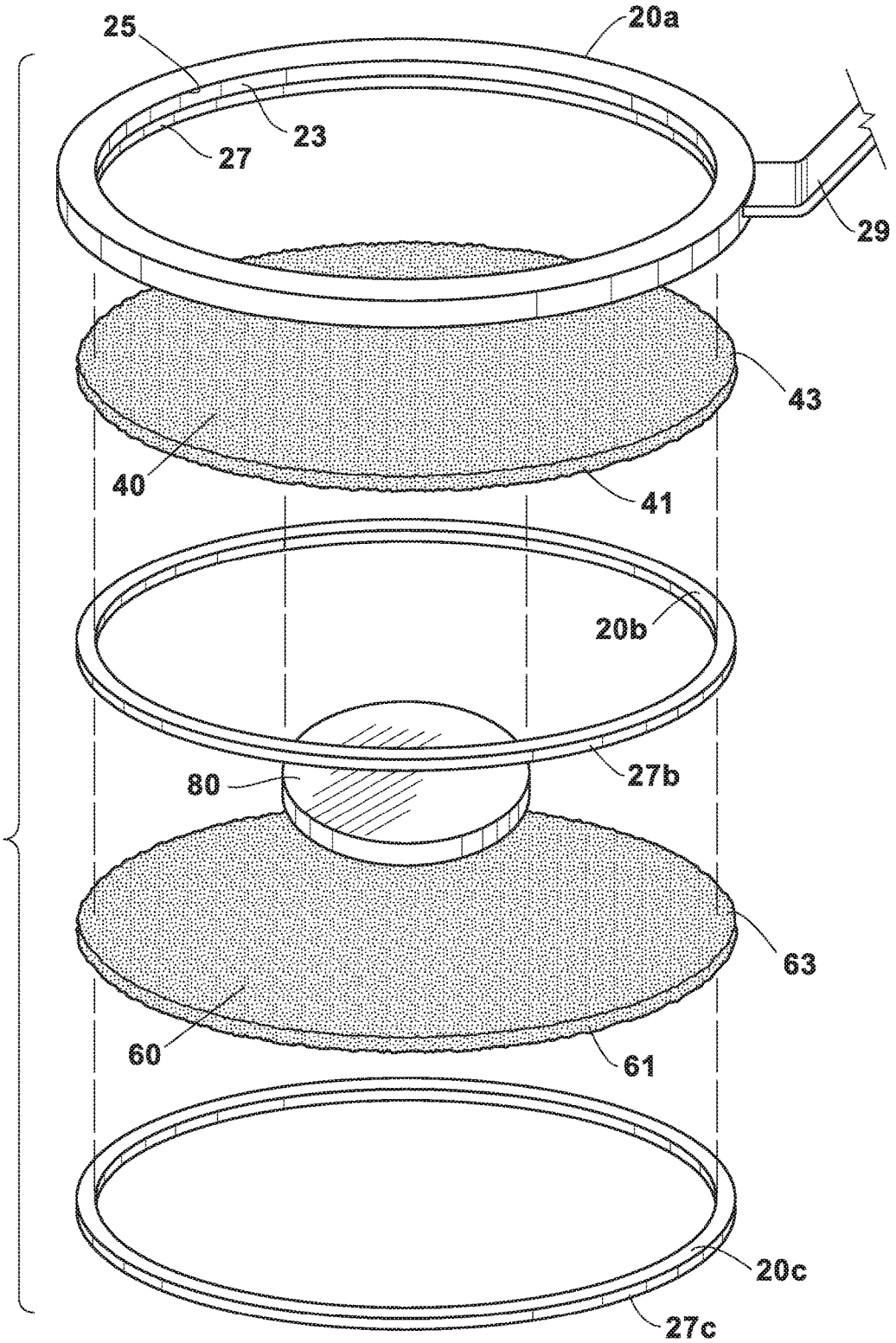
FIG. 8 is a front perspective assembly view of the strike pad of FIG. 1.

Looking at FIGS. 5-7 and 8, the rigid frame 20 shown includes upper, intermediate and lower portions 20*a*, 20*b* and 20*c*, respectively. Alternatively, the frame 20 need not include the intermediate portion 20*b*. As best seen in FIGS. 3 and 8, the upper portion 20*a* has an inside wall 23 that defines an endless inner perimeter 25. The upper portion 20*a* also has an endless lower seat 27 and an arm 29 that extends outwardly and upwardly from the upper portion 20*a* of the frame 20. The free end of the arm 29 is adapted to be connected to the linkage mounted on the bowl (not shown) to orient the frame 20 approximately horizontally in the bowl (not shown) when the toilet seat (not shown) is raised to its approximately vertical condition leaning back against the tank of the toilet tank (not shown).

The intermediate and lower portions 20*b* and 20*c* of the frame 20 are endless rings with outer perimeters 27*b* and 27*c* that are dimensionally congruent with the side wall of seat 27 in the upper portion 20*a* of the frame 20. Preferably, the frame 20 is ovate and the arm 29 is attached to a narrow end of the frame 20. A frame 20 made of styrene has been found to be suitable.

Looking again at FIGS. 1-4 and 8, the target and release pads 40 and 60 have perimeters 41 and 61 sized to overlap the endless inside perimeter 25 of the frame 20. The overlapping portions 43 and 63 of the perimeters 41 and 61 of the target and release pads 40 and 60 are secured in the frame 20.

The pads 40 and 60 are porous and the target pad 40 is preferably also splash-inhibiting. "Porous" as herein used relates to the permeability of water. "Splash-inhibiting" as herein used relates to texture enabling fragmentation of a stream of urine and absorption of at least a portion of the stream into the pad. As an example, furnace filter material such as FM100 synthetic plastic affords a suitable texture. The same porous and splash-inhibiting material may be used for both the target and release pads 40 and 60.

Continuing to look at FIGS. 1-4 and 8, the water-soluble product 80 is encapsulated in the pocket 81 formed between the pads 40 and 60. Preferably, the water-soluble product 80 is scented or disinfecting or both. Water-soluble product demonstrating other or additional characteristics may also be employed.

Figure 4:
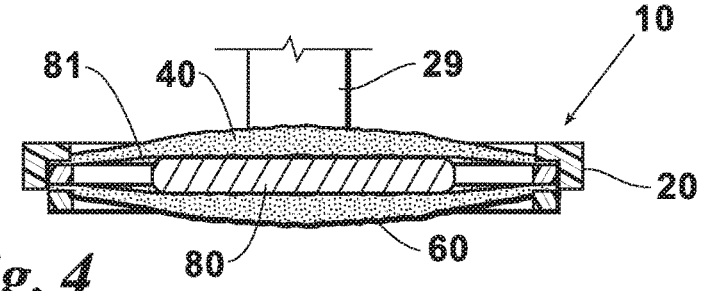
FIG. 4 is a cross-sectional view taken along the line 4-4 of FIG. 1.
Figure 5:
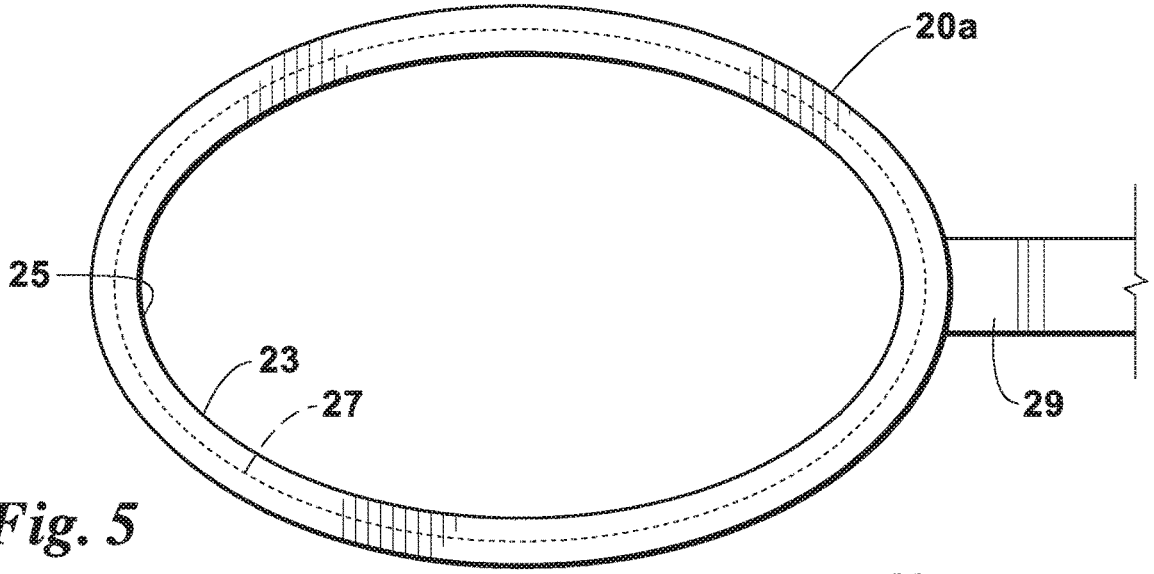
FIG. 5 is a top plan view of the upper portion of the frame of the strike pad of FIG. 1.
Figure 6:
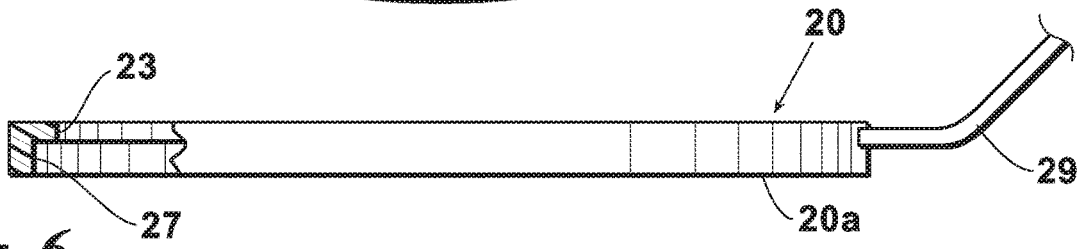
FIG. 6 is a front elevation view of the upper portion of the frame of the strike pad of FIG. 1 with parts broken away.
Figure 7:
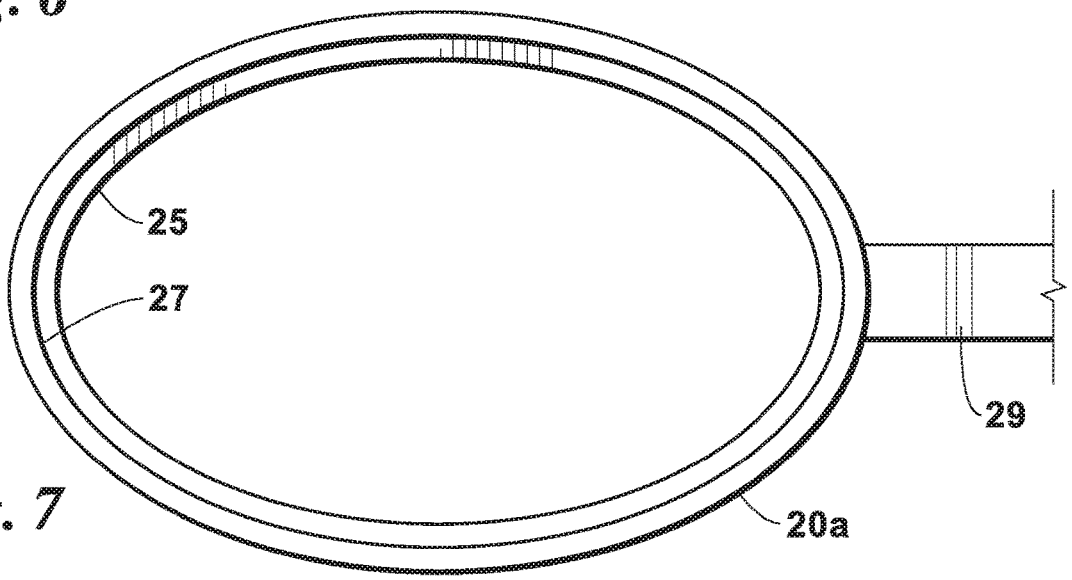
FIG. 7 is a bottom plan view of the upper portion of the frame of the strike pad of FIG. 1.

As seen in FIG. 8, one way of assembling the strike pad 10 is to overlay and adhesively tack the release and target pads 60 and 40 on top of their corresponding lower and intermediate portions 20*c* and 20*b* of the frame 20, forming sub-assemblies. With the water-soluble product 80 placed between pads 60 and 40, the sub-assemblies are vertically aligned and adhesively tacked with the perimeter 63 of the release pad 60 between the lower and intermediate portions 20*c* and 20*b* of the frame 20. To secure the sub-assembly to the upper portion 20*a* of the frame 20, the intermediate portion 20*b* of the frame 20 is press-fit engaged into and against the seat 27. As best seen in FIGS. 3 and 4, the perimeter 43 of the target pad 40 is between the intermediate portion 20*b* of the frame 20 and the seat 27 in the upper portion 20*a* of the frame 20. If the intermediate portion 20*b* is omitted, the bottom perimeter of the target pad 40 is abutted against the top perimeter of the release pad 60. The assembled portions 20*a*, 20*b* and 20*c*, or 20*a* and 20*c* if portion 20*b* is omitted, can then be heat sealed to form an integral frame 20. If the same porous and splash-inhibiting material is used for both the target and release pads 40 and 60, the combinations of each pad 40 or 60 with its corresponding frame portion 20*b* or 20*c* may be identical.

The strike pad 10 is mounted in the toilet bowl (not shown) by connecting the arm 29 of the strike pad 10 to the operating linkage (not shown) with the target pad 40 approximately horizontal and above the threshold standing water level of the bowl when the seat is in its raised approximately vertical condition. As shown, the arm 29 is of rectangular cross-section for use with a linkage having a mating socket that will press-fit grip the arm 29. The arm 29 can be cut to the length necessary to position the target pad 40 in its approximately horizontal condition. Preferably, the strike pad 10 will be positioned to orient the frame 20 approximately horizontally in the bowl with the release pad 60 and the water-soluble product 80 positioned at least partly below the threshold standing water level of the toilet bowl while the target pad is above the threshold standing water level of the bowl. The plug and the socket mating the arm 29 and the linkage may be of any cross-section. Other adjustable mechanisms for mating the arm 29 and the linkage may be employed.

In operation, with the toilet seat in its raised approximately vertical condition, the target pad 40 is above the threshold standing water level and presents a target for a urine stream. The splash-inhibiting target pad 40 fragments the stream and captures at least a portion of the stream in the pad. On flushing, the swirling high water flows through the porous target and release pads 40 and 60 to rinse the strike pad 10 and bring the water-soluble product 80 into contact with the swirling water, releasing some of the product from the strike pad 10. If the arm 29 positions a portion of the release pad 60 and the water-soluble product 80 in the standing water in the approximately horizontal condition of the strike pad 10, some product will be continuously released in the threshold standing water level condition.

Thus, it is apparent that there has been provided, in accordance with the invention, a toilet bowl strike pad that fully satisfies the objects, aims and advantages set forth above. While the invention has been described in conjunction with a specific embodiment thereof, it is evident that many alternatives, modifications and variations will be apparent to those skilled in the art and in light of the foregoing description. Accordingly, it is intended to embrace all such alternatives, modifications and variations as fall within the spirit of the appended claims.

What is claimed is:

1. For use in combination with a linkage mounted on a toilet bowl and operated in response to the rotation of a toilet seat toward a lowered approximately horizontal condition or a raised approximately vertical condition, a strike pad comprising:

a rigid frame defining an endless perimeter along an inside wall thereof;

a porous target pad having a perimeter sized to overlap said endless inside wall perimeter;

a porous release pad having a perimeter sized to overlap said endless inside wall perimeter;

said target and release pad perimeters being secured in said frame to form a pocket between said pads;

a water-soluble product encapsulated in said pocket; and an arm extending from said frame and adapted to be connected to the linkage to orient said frame approximately horizontally in the bowl with said porous target pad above a threshold standing water level of the bowl when the seat is in the raised approximately vertical condition.

2. A toilet bowl strike pad according to claim 1, said arm further adapted to be connected to the linkage to orient said frame approximately horizontally in the bowl with said porous release pad and said water-soluble product positioned at least partly below the threshold standing water level of the toilet bowl while said porous target pad is above the threshold standing water level of the bowl.

3. A toilet bowl strike pad according to claim 1, said porous target pad being splash inhibiting.

4. A toilet bowl strike pad according to claim 1, said water-soluble product releasing a scent when dissolving in water.

5. A toilet bowl strike pad according to claim 1, said water-soluble product releasing a disinfectant when dissolving in water.

6. A toilet bowl strike pad according to claim 1, said frame being ovate.

7. A toilet bowl strike pad according to claim 1, said frame comprising a laminar arrangement of frame portions securing said perimeters of said target and release pads.

* * * * *